United States Patent [19]

Aoyama

[11] 4,312,494

[45] Jan. 26, 1982

[54] VALVE DEVICE USING AN ON-OFF FUNCTIONING TYPE ELECTROMAGNETIC ACTUATOR

[75] Inventor: Shunichi Aoyama, Yokohama, Japan

[73] Assignee: Nissan Motor Co., Ltd., Yokohama, Japan

[21] Appl. No.: 161,376

[22] Filed: Jun. 20, 1980

[30] Foreign Application Priority Data

Jul. 3, 1979 [JP] Japan ..... 54-90808[U]

[51] Int. Cl.[3] ..... F16K 31/02; F01L 1/16; F01L 9/04

[52] U.S. Cl. ..... 251/48; 123/90.11; 123/90.15; 123/90.49; 123/90.66; 123/90.67; 188/317; 251/129

[58] Field of Search ..... 123/90.11, 90.49, 90.55, 123/90.65, 90.66, 90.15, 90.67; 188/282, 317; 251/48, 129

[56] References Cited

U.S. PATENT DOCUMENTS

| | | | |
|---|---|---|---|
| 1,353,993 | 9/1920 | Fisher | 123/90.55 |
| 1,427,111 | 8/1922 | Knudsen | 251/48 |
| 1,675,954 | 7/1928 | Page | 123/90.49 |
| 1,887,078 | 11/1932 | Wheaton | 251/48 |
| 2,108,514 | 2/1938 | Summers | 123/90.55 |
| 3,678,096 | 7/1972 | Repko et al. | 123/90.49 |
| 3,727,595 | 4/1973 | Links | 123/90.15 |
| 3,882,833 | 5/1975 | Longstaff et al. | 123/90.11 |

FOREIGN PATENT DOCUMENTS

| | | | |
|---|---|---|---|
| 2458635 | 6/1976 | Fed. Rep. of Germany | 123/90.11 |
| 54-114635 | 9/1979 | Japan | 123/90.55 |
| 79850 | 5/1919 | Switzerland | 251/48 |

*Primary Examiner*—Martin P. Schwadron
*Assistant Examiner*—G. L. Walton
*Attorney, Agent, or Firm*—Lane, Aitken, Kice & Kananen

[57] ABSTRACT

A piston is biased by a valve so as to decrease the volume of a chamber just before seating of the valve on the valve seat and brakes and slows up movement of the valve towards the valve seat by compressing a hydraulic fluid in the chamber and forcing out the hydraulic fluid from the chamber through a hole at a limited flow rate.

2 Claims, 1 Drawing Figure

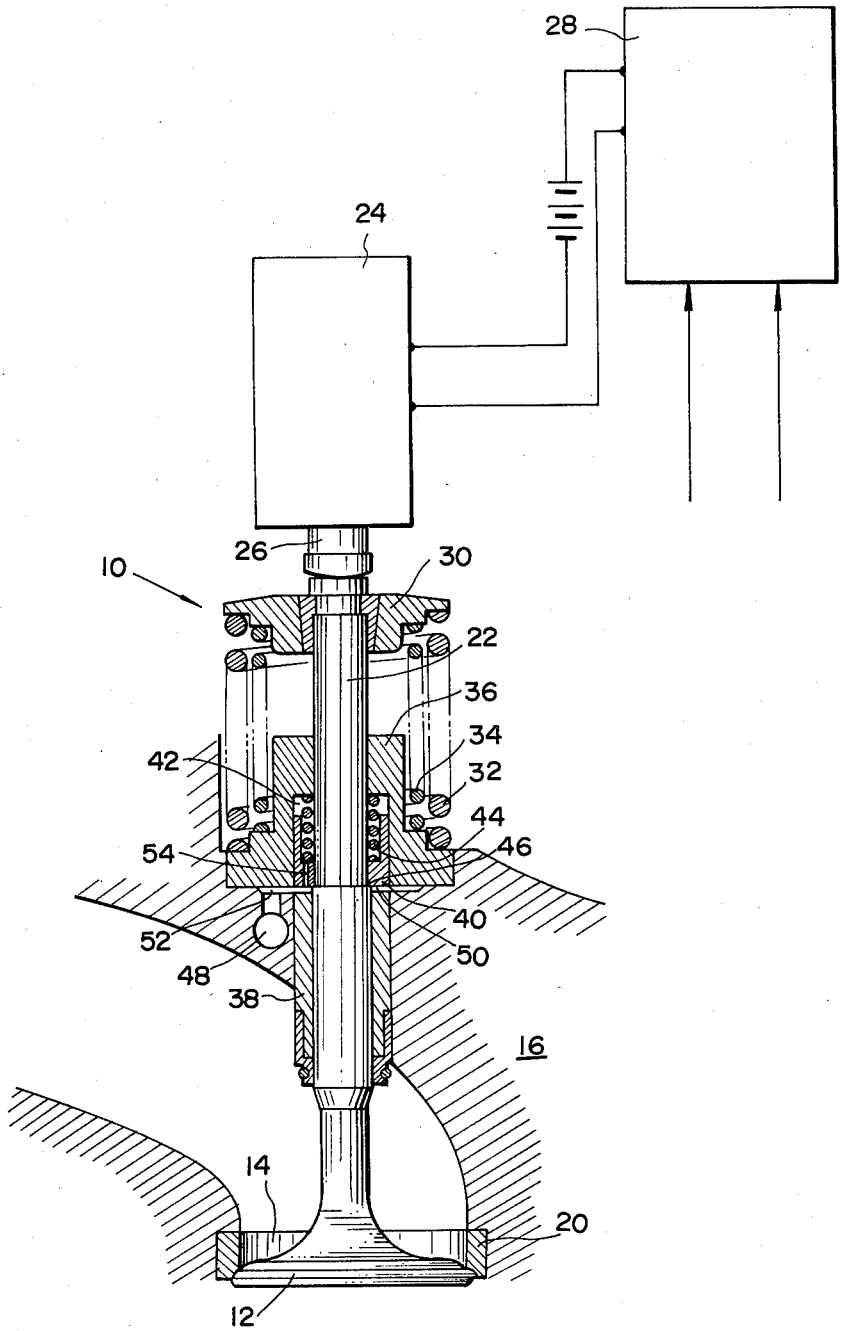
28
24
26
30
10
22
36
34
42
32
44
54
46
40
52
50
48
38
16
14
20
12

VALVE DEVICE USING AN ON-OFF FUNCTIONING TYPE ELECTROMAGNETIC ACTUATOR

BACKGROUND OF THE INVENTION

1. Field of the Invention

The present invention relates to a valve device which is operated by an electromagnetic actuator of an on-off functioning type.

2. Description of the Prior Art

As is well known in the art, in most internal combustion engines, opening and closing of intake and exhaust valves have been heretofore generally performed by cams. The profile of the cam is precisely made so that the valve is smoothly and gently opened and closed even when the engine operates at a high speed. Specifically, the profile of the cam for closing the valve has a damping curve so that the valve is made to smoothly and gently take the valve seat but is prevented from abruptly seating thereon.

However, as electronics is applied to automobiles in recent years, a technique is being developed which uses an electromagnetic actuator so as to effectively operate intake and exhaust valves and control the timing of opening and closing of the valves in accordance with the operating condition of the engine. In this instance, the valve is operated by on and off operation of the electromagnetic actuator so that when the actuator is fed with electric current, the valve is opened by the actuator and when the feed of electric current to the actuator is cut off, the valve is closed by a return spring. However, the valve has not been provided with an expedient which has the valve smoothly and gently take the valve seat.

For this reason, it has been unavoidable that the valve is closed by colliding against the valve seat. Specifically, an exhaust valve exposed to combustion gas having a high temperature has suffered severe wear and tear so that the life of the valve has been sharply shortened. Also, great vibration and noise have been produced because of collision of the valve with the valve seat.

SUMMARY OF THE INVENTION

It is, therefore, an object of the invention to provide a valve device operated by an on-off functioning electromagnetic actuator which is so improved that a valve is closed by smoothly and gently taking the valve seat without colliding therewith.

This object is attained by providing damping means for slowing up movement of the valve in opposition to the action of a return spring just before seating of the valve on the valve seat.

The damping means comprises, for example, means for defining a chamber; means for passing a hydraulic fluid into the chamber and the hydraulic fluid out of the chamber, the passing means being constructed such that it limits the flow of the hydraulic fluid passing therethrough; means for braking the movement of the valve towards the valve seat just before seating of the valve thereon, the braking means being movable in opposite directions such that it increases the volume of the chamber to admit the hydraulic fluid into the chamber through the passing means when the valve is moved away from the valve seat and that the braking means decreases the volume of the chamber to compress the hydraulic fluid therein when the valve is moved towards the valve seat; the valve being constructed and arranged such that just before seating of the valve on the valve seat, the valve biases the braking means to decrease the volume of the chamber and the movement of the valve towards the valve seat is braked and slowed up by the braking means compressing the hydraulic fluid in the chamber due to the action of the valve and forcing out the hydraulic fluid from the chamber through the passing means at a limited flow rate.

Also, the damping means comprises, for example, means for defining a chamber; a piston for braking the movement of the valve towards the valve seat just before seating of the valve thereon, the piston having a hole for passing a hydraulic fluid into the chamber and the hydraulic fluid out of the chamber, the hole having a relatively small diameter such that the hole limits the flow of the hydraulic fluid passing therethrough, the piston being movable in opposite directions such that the piston increases the volume of the chamber to admit the hydraulic fluid into the chamber through the hole when the valve is moved away from the valve seat and that the piston decreases the volume of the chamber to compress the hydraulic fluid therein when the valve is moved towards the valve seat; the valve having a valve stem constructed and arranged such that just before seating of the valve on the valve seat, the valve stem abuts against the piston so as to bias the same to decrease the volume of the chamber and the movement of the valve towards the valve seat is braked and slowed up by the piston compressing the hydraulic fluid in the chamber due to the action of the valve and forcing out the hydraulic fluid from the chamber through the hole at a limited flow rate.

The advantages of the valve device according to the invention are that wear and tear on the valve are considerably reduced to greatly lengthen the life of the valve and that the production of vibration and noise due to seating of the valve on the valve seat are prevented or are greatly reduced.

BRIEF DESCRIPTION OF THE DRAWING

A single drawing is a schematic and sectional view of a preferred embodiment of a valve device according to the present invention.

DESCRIPTION OF THE PREFERRED EMBODIMENT

In this embodiment, the present invention is applied to intake and exhaust valves of an internal combustion engine. The single drawing shows only the application to one of the intake and exhaust valves for brevity.

In the drawing, a valve device 10 comprises an intake valve or an exhaust valve 12 arranged at an intake port or an exhaust port 14 of an intake passage or an exhaust passage formed in a cylinder head 16 of an internal combustion engine. The valve 12 is seated on a valve seat 20 fixedly disposed in the port 14 and has a valve stem 22. An electromagnetic actuator 24 of an on-off functioning type has a plunger 26 for moving the valve 12 away from the valve seat 20 thereby opening the port 14. The plunger 26 is movable axially of the valve stem 22 and abuts at an end against the tip of the valve stem 22. A control circuit 28 for controlling the timing of opening and closing of the intake and exhaust valves is electrically connected to the actuator 24 and receives an input signal representative of an operating condition of the engine to control feed of electric current to the actuator 24.

A spring retainer 30 is fixed to the valve stem 22 and supports two return springs 32 and 34 jointly with a spring supporter 36 which is fixed to the cylinder head 16 and which is disposed on the valve stem 22. The return springs 32 and 34 press the valve stem 22 against the plunger 26 through the spring retainer 30 and biases the valve 12 to take the valve seat 20. A valve guide 38 is fixed to the cylinder head 16 and is disposed on the valve stem 22.

A piston 40 is slidably disposed in the spring supporter 36 and on the valve stem 22 and faces the valve guide 38 to move between the position shown in the drawing and the valve guide 38. An annular chamber 42 is defined in the spring supporter 36 by the piston 40 to surround the valve stem 22. The valve stem 22 is slidably supported by the spring supporter 36, the valve guide 38 and the piston 40. The valve stem 22 has a shoulder 46. A spring 44 is disposed in the chamber 42 and presses the piston 40 against the shoulder 46 of the valve stem 22. The return springs 32 and 34 press the shoulder 46 of the valve stem 22 against the piston 40. In order to prevent downward movement of the piston 40 in excess of an extent in the drawing so that the shoulder 46 of the valve stem 22 abuts against the piston 40 just before the valve 12 takes the valve seat 20 when the valve 12 is moved towards the valve seat 20, the piston 40 is apart by a suitable distance from the valve guide 38 when the valve 12 is in its closed position.

A gallery 48 communicates with a pressurized hydraulic fluid source (not shown) to receive hydraulic fluid therefrom and communicates with a space 50 between the piston 40 and the valve guide 38 through a passage 52 to feed a hydraulic fluid to the space 50. The piston 40 is formed with a hole 54 which provides communication between the chamber 42 and the space 50. The hole 54 has a relatively small diameter so that the hole 54 limits the flow of hydraulic fluid passing therethrough.

The valve device 10 thus constructed operates as follows:

When the actuator 24 is fed with no electric current by the control circuit 28, the valve stem 22 is moved by the action of the return springs 32 and 34 such that the valve 12 is seated on the valve seat 20 and the plunger 26 is retracted into the actuator 24, as shown in the drawing. The piston 40 is held by the shoulder 46 of the valve stem 22 in a position most remote from the valve guide 38 to make the volume of the chamber 42 minimum.

At this state, when the actuator 24 is fed with electric current by the control circuit 28, the plunger 26 is protruded against the force of the return springs 32 and 34 to move the valve stem 22 downwards in the drawing such that the valve 12 is unseated from the valve seat 20. The downward movement of the valve stem 22 allows the spring 44 to move the piston 40 downwards until the piston 40 abuts against the valve guide 38. During the downward movement of the piston 40, the volume of the chamber 42 is increased to admit the hydraulic fluid from the space 50 into the chamber 42 through the hole 54.

When the control circuit 28 cuts off the feed of electric current to the actuator 24 in order to put the valve 12 into its closed state, the valve stem 22 is moved upwards by the action of the return springs 32 and 34 and the plunger 26 is retracted into the actuator 24. Just before the valve 12 takes the valve seat 20, the shoulder 46 of the valve stem 22 abuts against the piston 40 to bias the same to decrease the volume of the chamber 42. The piston 40 compresses the hydraulic fluid in the chamber 42 due to the action of the valve stem 22 and forces out the hydraulic fluid from the chamber 42 into the space 50 through the hole 54 at a limited flow rate, so that the upward movement of the valve stem 22 is braked and slowed up by the piston 40 and the hydraulic fluid in the chamber 42. Accordingly, the upward movement of the valve stem 22 becomes slower than before abutting of the shoulder 46 against the piston 40. As a result, the valve 12 is smoothly and gently seated on the valve seat 20 and is prevented from colliding with the valve seat 20. Thus, wear and tear on the valve 12 are considerably reduced to greatly lengthen the life of the valve 12 and the production of vibration and noise due to seating of the valve 12 on the valve seat 20 are prevented or are greatly reduced. In addition to the effect stated above, the invention has an effect that the hydraulic fluid in the chamber 42 cools the valve 12.

Further, as the speed of the engine increases, since time spent upon the downward movement of the valve 12 is shortened to reduce the quantity of hydraulic fluid flowing into the chamber 42 through the hole 54 to shorten the displacement of the piston 40 which is produced by the downward movement thereof, the position at which the shoulder 46 of the valve stem 22 abuts against the piston 40 becomes nearer to the position of the piston 40 shown in the drawing to reduce the time of damping the upward movement of the valve stem 22. This characteristic of the damping means 40, 42, 44 and 46 suits the operation of the valve 12.

Although the invention has been described as being applied to intake and exhaust valves of an internal combustion engine, the invention can be also applied to valve devices for other purposes so far as the valve devices are operated by electromagnetic actuators of on-off functioning types.

What is claimed is:

1. A valve device comprising:

a valve seat fixedly disposed in a port section of a fluid passage;

a movable valve having a valve steam and which is seated on the valve seat to close the port section;

an electromagnetically operated actuator for moving said valve to leave the valve seat thereby opening the port section;

a return spring arranged to bias said valve to take the valve seat; and damping means for slowing up the movement of said valve towards the valve seat in opposition to the force of the return spring just before seating of said valve on the valve set so that said valve is gently seated on the valve seat, said damping means comprising:

means for defining a chamber;

a piston for braking the movement of said valve towards the valve seat just before seating of said valve thereon, said piston having a hole for passing a hydraulic fluid into said chamber and the hydraulic fluid out of said chamber, said hole having a relatively small diameter such that said hole limits the flow of hydraulic fluid passing therethrough, said piston being movable in opposite directions such that said piston increases the volume of said chamber to admit the hydraulic fluid into said chamber through said hole when said valve is moved away from the valve seat and that said piston decreases the volume of said chamber to compress the hydraulic fluid therein when said valve is moved towards the valve seat;

said valve stem being constructed and arranged such that just before seating of said valve on the valve seat, said valve stem abuts against said piston so as to bias the same to decrease the volume of said chamber and the movement of said valve towards the valve seat is braked and slowed up by said piston compressing the hydraulic fluid in said chamber due to the action of said valve and forcing out the hydraulic fluid from said chamber through said hole at a limited flow rate.

2. A valve device according to claim 1, further comprising a spring supporter disposed on said valve stem stationarily with respect thereto and supporting an end of the return spring and a valve guide disposed on said valve stem stationarily with respect thereto, wherein said piston is slidably disposed on said valve stem and in said spring supporter to define said chamber therein, said valve stem having a shoulder abutting against said piston such that just before seating of said valve on the valve seat, the valve stem biases said piston to decrease the volume of said chamber, said valve guide being arranged in such a position that said valve guide prevents said piston from being moved in excess of an extent in the direction to increase the volume of said chamber and said shoulder of said valve stem abuts against said piston just before said valve takes the valve seat.

* * * * *